US009224556B2

(12) United States Patent
Arihara et al.

(10) Patent No.: US 9,224,556 B2
(45) Date of Patent: Dec. 29, 2015

(54) SWITCH

(71) Applicant: OMRON Corporation, Kyoto-shi, Kyoto (JP)

(72) Inventors: Takeshi Arihara, Kyoto (JP); Tomoyuki Washizu, Shiga (JP); Takekazu Komori, Shiga (JP); Masaru Morimoto, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/384,338

(22) PCT Filed: Mar. 11, 2013

(86) PCT No.: PCT/JP2013/056669

§ 371 (c)(1),
(2) Date: Sep. 10, 2014

(87) PCT Pub. No.: WO2013/137203

PCT Pub. Date: Sep. 19, 2013

(65) Prior Publication Data

US 2015/0047956 A1 Feb. 19, 2015

(30) Foreign Application Priority Data

Mar. 14, 2012 (JP) ..... 2012-057553

(51) Int. Cl.

| | |
|---|---|
| ***H01H 21/14*** | (2006.01) |
| ***H01H 1/24*** | (2006.01) |
| ***H01H 1/44*** | (2006.01) |
| ***H01H 3/38*** | (2006.01) |
| ***H01H 21/24*** | (2006.01) |
| ***H01H 1/36*** | (2006.01) |
| ***H01H 21/12*** | (2006.01) |
| ***H01H 21/36*** | (2006.01) |

(52) U.S. Cl.

CPC ..... *H01H 21/14* (2013.01); *H01H 1/242* (2013.01); *H01H 1/36* (2013.01); *H01H 1/44* (2013.01);

(Continued)

(58) Field of Classification Search

CPC ..... H01H 1/18; H01H 1/20; H01H 1/26; H01H 2221/088; H01H 3/42; H01H 21/12; H01H 2221/036; H01H 3/40; H01H 1/40; H01H 1/44; H01H 21/24; H01H 2203/036; H01H 1/36; H01H 3/04; H01H 9/02; H01H 21/28; H01H 19/14; H01H 1/242; H01H 3/38

USPC ..... 200/252, 16 R–16 D, 520, 530–536, 553, 200/557–559, 561–563, 276.1, 61.82, 8 R, 200/17 R, 260, 11 R, 335

See application file for complete search history.

(56) References Cited

U.S. PATENT DOCUMENTS 6,768,069 B1 * 7/2004 Su ..... H01H 1/242 200/276.1
6,917,008 B1 * 7/2005 Ni ..... H01H 21/282 200/16 C (Continued)

FOREIGN PATENT DOCUMENTS

JP 2005-026035 A 1/2005
JP 2005-100918 A 4/2005

(Continued)

OTHER PUBLICATIONS

International Search Report issued in PCT/JP2013/056669 mailed on Jun. 4, 2013 (4 pages).

*Primary Examiner* — Edwin A. Leon
(74) *Attorney, Agent, or Firm* — Osha Liang LLP

(57) ABSTRACT

A switch has a base having a frame integrally formed on a periphery of an upper face of the base, a fixed contact formed on an inner side face of the frame, and a support protrusion that protrudes from the upper face of the base that is integrally formed so as to expose a common fixed contact, an electrically conductive spring member whose connecting part arranged at a center of a spiral spring is nonrotatably supported by the support protrusion and that extends a driving piece from the free end of the spiral spring, and an actuating lever whose one end is rotatably supported by the upper face of the base and that integrally forms an actuating trigger that presses the driving piece of the electrically conductive spring member.

8 Claims, 6 Drawing Sheets

(52) U.S. Cl.
CPC ..... *H01H 3/38* (2013.01); *H01H 21/12* (2013.01); *H01H 21/24* (2013.01); *H01H 21/36* (2013.01); *H01H 2205/002* (2013.01); *H01H 2235/01* (2013.01)

(56) References Cited

U.S. PATENT DOCUMENTS 7,223,931 B2 * 5/2007 Kiyono ..... H01H 1/36 200/276.1
2003/0094360 A1 * 5/2003 Nishimura ..... H01H 19/62 200/559
2006/0246755 A1 11/2006 Kiyono et al.
2006/0254889 A1 11/2006 Kiyono et al.

FOREIGN PATENT DOCUMENTS

JP 2006-310229 A 11/2006
JP 2007-305458 A 11/2007
JP 4062319 B2 3/2008
JP 2011-171164 A 9/2011

* cited by examiner

SWITCH

BACKGROUND

1. Technical Field

The present invention relates to a switch, and in particular, to an ultrasmall thin switch for use in electronic devices such as mobile phones, smartphones, and digital cameras.

2. Related Art

A switch is known that includes, for example, a base, a movable contacting piece that includes a coil spring and whose one end is rotatably supported by the base, an actuating lever whose one end is pivotably supported by the base and that presses a coil of the movable contacting piece by a driving part that extends from the one end, and a cover that has a planar shape that can cover the base and is fixed to the base so as to compress the coil, in which the coil of the movable contacting piece is pressed by the actuating lever to impart a torsional moment, thereby causing the movable contacting piece to rotate about its one end, causing the coil of the movable contacting piece to slide on at least one fixed contact exposed out of the surface of a protrusion protruding from the bottom face of the base, and causing the other end of the movable contacting piece to slide on a common fixed contact exposed out of the inner side face of the base (refer to Patent Document 1).

CITATION LIST

Patent Document

Patent Document 1: Japanese Patent No. 4062319

SUMMARY

However, because the above switch ensures contact pressure using the spring force of the spiral coil spring, there is a limit to reducing a height dimension. It is not easy to mass-produce spiral coil springs having a complicated shape by press molding with high dimension accuracy, and hence, it is difficult to achieve an ultrasmall switch having a desired stroke and contact pressure.

An ultrathin switch according to one or more embodiments of the present invention has a small height dimension while ensuring a desired stroke and contact pressure.

A switch according to one or more embodiments of the present invention includes a base that forms a fixed contact on an inner side face of a frame integrally formed on a periphery of the upper face thereof and protrudes a support protrusion that is integrally formed so as to expose a common fixed contact on the upper face thereof; an electrically conductive spring member whose connecting part arranged at a center of a spiral spring is nonrotatably supported by the support protrusion and that extends a driving piece from the free end of the spiral spring; and an actuating lever whose one end is rotatably supported by the upper face of the base and that integrally forms an actuating trigger that presses the driving piece of the electrically conductive spring member. The fixed contact and the common fixed contact being electrically connected or disconnected through the electrically conductive spring member by rotating the actuating lever to press the driving piece of the electrically conductive spring member by the actuating trigger and elastically deforming the spiral spring thereby to cause the movable contact formed on the electrically conductive spring member to be connected or disconnected with the fixed contact.

One or more embodiments of the present invention, unlike conventional examples, eliminates the need for using a coil spring, thereby achieving a thin switch having a small height dimension.

The electrically conductive spring member is formed by the spiral spring, thereby achieving a switch that not only achieves a desired operation stroke but also facilitates uniform stress dispersion and resists a fatigue breakdown.

In one or more embodiments of the present invention, the movable contact may be formed at the tip of the driving piece, and the fixed contact and the common fixed contact may electrically be connected or disconnected through the electrically conductive spring member by rotating the actuating lever to press the driving piece of the electrically conductive spring member by the actuating trigger and elastically deforming the spiral spring thereby to cause the movable contact to be connected or disconnected with the fixed contact.

One or more embodiments of the present invention can press the movable contact formed on the driving piece directly against the fixed contact through the operative power of the actuating lever, thereby ensuring high contact pressure.

In one or more embodiments of the present invention, the driving piece and the movable contact may be formed at the free end of the spiral spring in a branched manner, and the fixed contact and the common fixed contact may electrically be connected or disconnected through the electrically conductive spring member by rotating the actuating lever to press the driving piece of the electrically conductive spring member by the actuating trigger and elastically deforming the spiral spring thereby to cause the movable contact to be connected or disconnected with the fixed contact.

One or more embodiments of the present invention can press the movable contact indirectly against the fixed contact through the driving piece, thereby achieving a switch that is easy to elastically deform and has a soft operation feeling.

In one or more embodiments of the present invention, the movable contact may be arranged at the tip of a return spring that extends from the free end of the electrically conductive spring member.

One or more embodiments of the present invention can bring the movable contact into contact with the fixed contact through the return spring, thereby achieving a switch having high contact reliability that is less likely to produce a contact failure even when vibration is applied.

In one or more embodiments of the present invention, the electrically conductive spring member and the actuating trigger of the actuating lever may have the same thickness dimension.

One or more embodiments of the present invention can house the electrically conductive spring member and the actuating lever within a space of the same height, thereby producing the effect of achieving a small-sized switch that is extremely thinner than conventional examples.

DETAILED DESCRIPTION

Embodiments of the present invention will be described with reference to the attached drawings of FIG. 1 to FIG. 6B. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As illustrated in FIG. 1 to FIG. 4B, a switch of a first embodiment includes a base 10, an electrically conductive spring member 20, an actuating lever 30, and a cover 40. For the convenience of description, the cover 40 is not illustrated in FIGS. 3A-3B.

Figure 1:
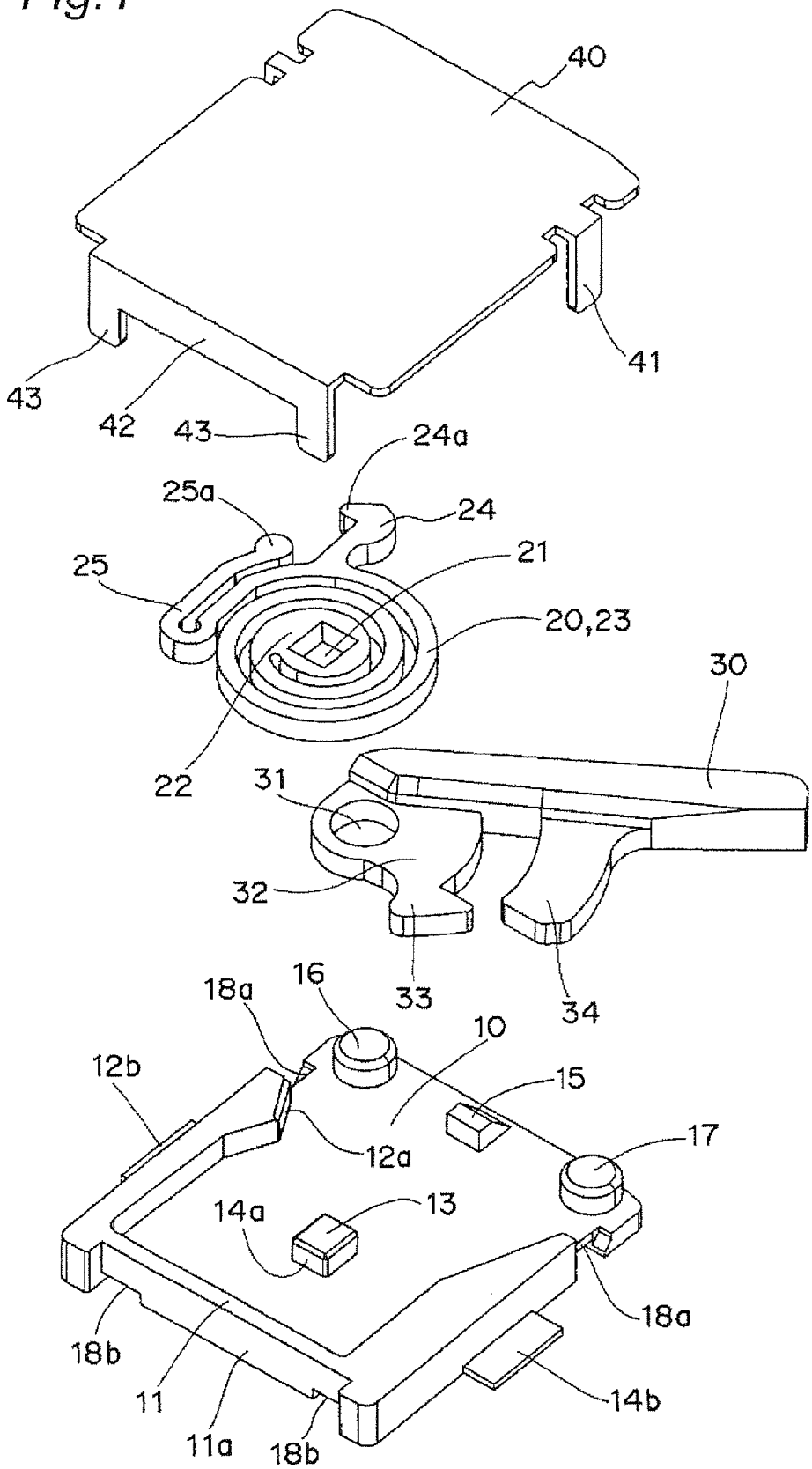
FIG. 1 is an exploded perspective view illustrating a switch according to a first embodiment of the present invention.

As illustrated in FIG. 1, the base 10 is integrally molded with a nearly U-shaped frame 11 extending along the periphery of a nearly square-shaped upper face. Insert-molded in the frame 11 is a normally open fixed contact 12*a* which is exposed on one end of the inner side of the frame 11. The base 10 is also integrally molded with a quadrangular prism-shaped support protrusion 13 protruding nearly at the center of the upper face thereof, which has an inserted-molded common fixed contact 14*a* on sides thereof. The normally open fixed contact 12*a* and the common fixed contact 14*a* each include terminals 12*b*, 14*b*, respectively, protruding from the outer side face of the base 10. The base 10 also includes a shaft 16 and a stopper 17 protruding from one periphery of the upper face thereof, between which a position restricting protrusion 15 is interposed.

The electrically conductive spring member 20 is manufactured by electroforming, in which a spiral spring 23 extends from a connecting part 22 that is positioned at the center and has a rectangular fitting hole 21. The electrically conductive spring member 20 has a driving piece 24 and a nearly U-shaped return spring 25 both extending from the free end of the spiral spring 23.

Figure 3A:
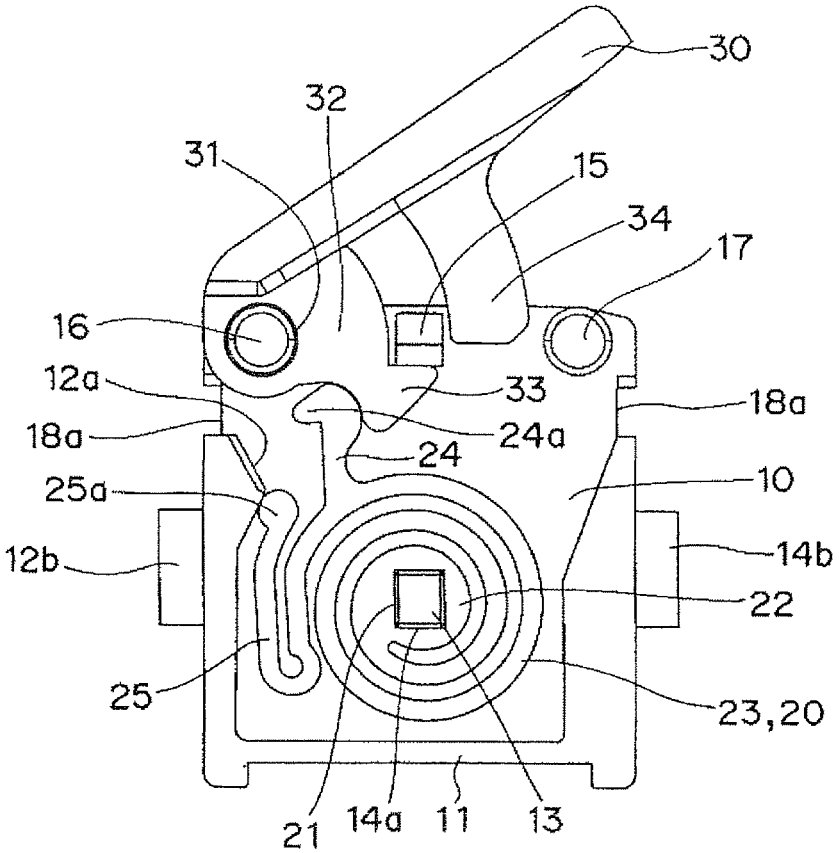
FIG. 3A and FIG. 3B are elevational views of the switch illustrated in FIG. 1 before and after being operated, respectively.
Figure 3B:
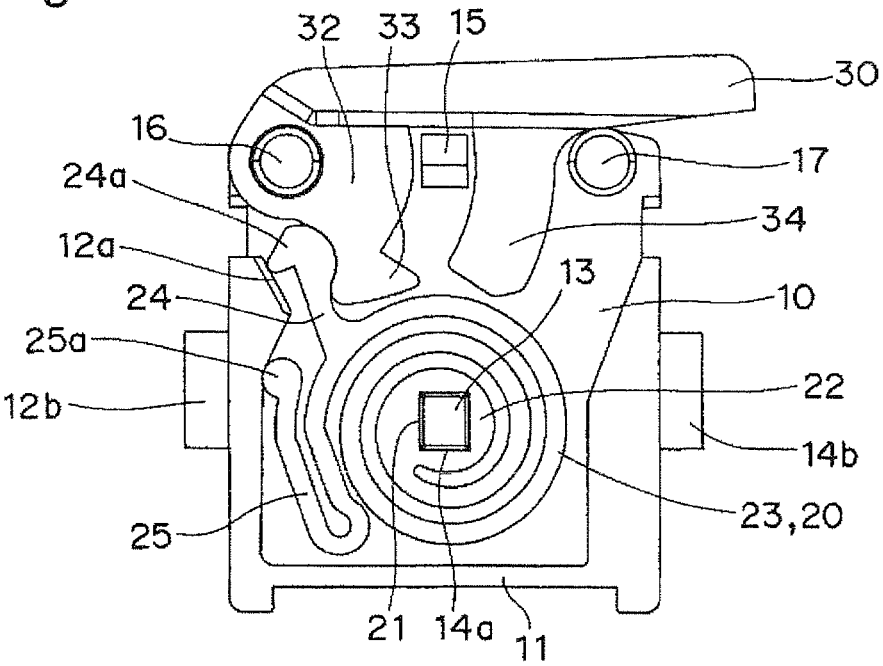

The fitting hole 21 formed in the connecting part 22 of the electrically conductive spring member 20 is fitted onto the support protrusion 13 of the base 10, thereby bringing a tip 25*a* of the return spring 25 into pressure contact with the inner side face of the frame 11 (FIGS. 3A-3B).

The shape of the support protrusion 13 and the fitting hole 21 is not limited to a quadrangle and is only required to be such a shape that the spiral spring 23 itself does not rotate or move when the spiral spring 23 expands and contracts.

As illustrated in FIG. 1, the actuating lever 30 integrally forms an actuating trigger 32 having a shaft hole 31 at its one end, forms a nearly trapezoidal latch member 33 at the free end of the actuating trigger 32, and integrally forms a guide arm 34 from its intermediate part.

As illustrated in FIGS. 3A-3B, when the shaft hole 31 of the actuating lever 30 is fitted onto the shaft 16 of the base 10, the actuating trigger 32 is in pressure contact with the driving piece 24 of the electrically conductive spring member 20 to be biased toward a return direction. This causes the latch member 33 of the actuating trigger 32 to engage with the position restricting protrusion 15 and is positionally restricted.

Figure 2:
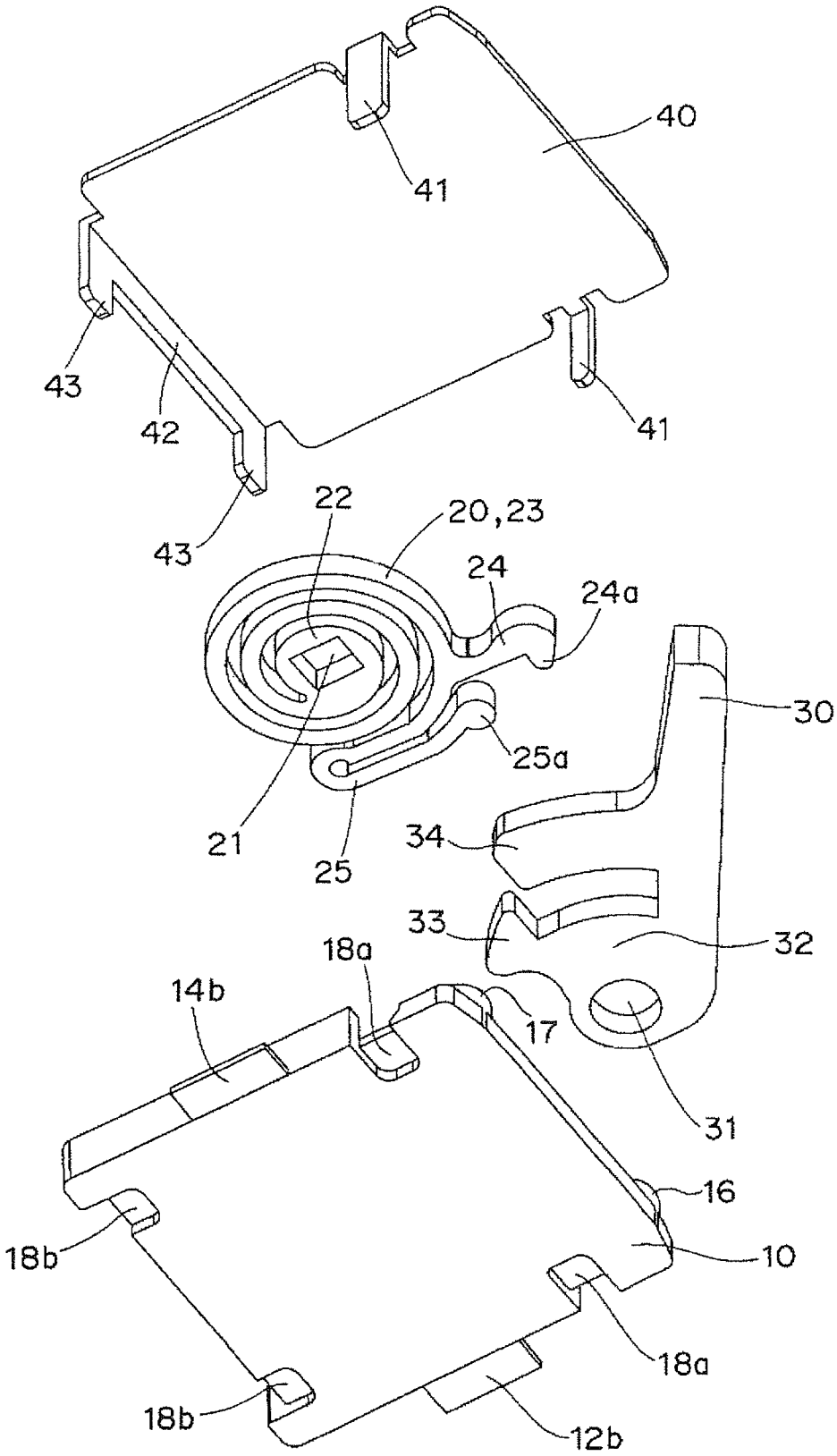
FIG. 2 is an exploded perspective view of the switch illustrated in FIG. 1 viewed from a different angle.

As illustrated in FIG. 1 and FIG. 2, the cover 40 has a planar shape that can cover the surface of the base 10 and forms bending parts 41 at positions that can engage with notches 18*a* formed in two opposite sides of the base 10. The cover 40 forms an engagement part 42 at a position that can fit into an engagement recess 11*a* formed in the frame 11. Bending parts 43 that can engage with notches 18*b* formed in the base 10 are formed at both ends of the engagement part 42.

The cover 40 is positioned against and covers the base 10 to which the electrically conductive spring member 20 and the actuating lever 30 are assembled. Next, the bending parts 41 of the cover 40 are bent to engage with the notches 18*a* of the base 10. Furthermore, the engagement part 42 of the cover 40 engages with the engagement recess 11*a* of the frame 11, and the bending parts 43 are bent to engage with the notches 18*b*, thereby preventing the electrically conductive spring member 20 and the actuating lever 30 from being disengaged.

Next, a method for operating the switch having the above components will be described.

As illustrated in FIG. 3A, before actuation, the spring force of the nearly U-shaped return spring 25 brings the driving piece 24 of the electrically conductive spring member 20 into pressure contact with the actuating trigger 32 of the actuating lever 30 and biases the actuating lever 30 toward the return direction. However, the latch member 33 formed on the actuating trigger 32 of the actuating lever 30 is in contact with the position restricting protrusion 15 and is positionally restricted. In this situation, although the connecting part 22 of the electrically conductive spring member 20 is in contact with the common fixed contact 14*a*, a movable contact 24*a* formed at the tip of the driving piece 24 is not in contact with the normally open fixed contact 12*a* formed on the inner side face of the frame 11.

When the free end of the actuating lever 30 is pressed down, the latch member 33 of the actuating trigger 32 presses the driving piece 24 with the shaft 16 as an axis, the spiral spring 23 of the electrically conductive spring member 20 is compressed, and the return spring 25 is compressed. This brings the movable contact 24*a* formed on the driving piece 24 into contact with the normally open fixed contact 12*a* and causes the common fixed contact 14*a* and the normally open fixed contact 12*a* to be electrically connected through the electrically conductive spring member 20.

Next, when the pressing force on the actuating lever 30 is released, the actuating trigger 32 of the actuating lever 30 is pressed back through the spring force of the spiral spring 23 and the return spring 25 of the electrically conductive spring member 20. This causes the actuating lever 30 to rotate in the opposite direction around the shaft 16 to return to the original position, disconnecting the movable contact 24*a* of the driving piece 24 from the normally open fixed contact 12*a*.

Figure 4A:
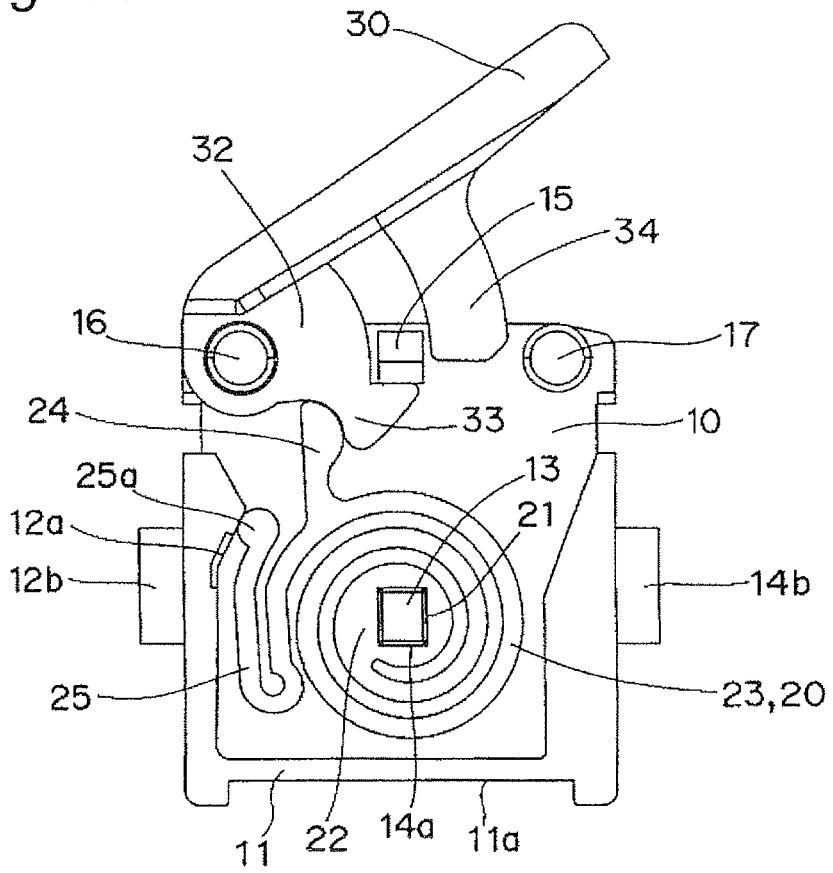
FIG. 4A and FIG. 4B are elevational views of a switch according to a second embodiment of the present invention before and after being operated, respectively.
Figure 4B:
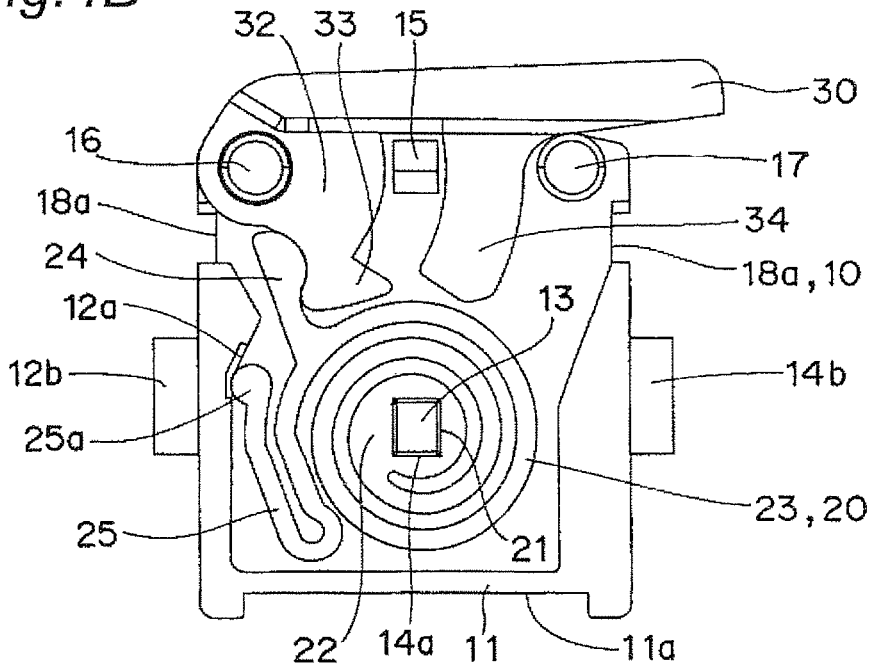
Figure 5A:
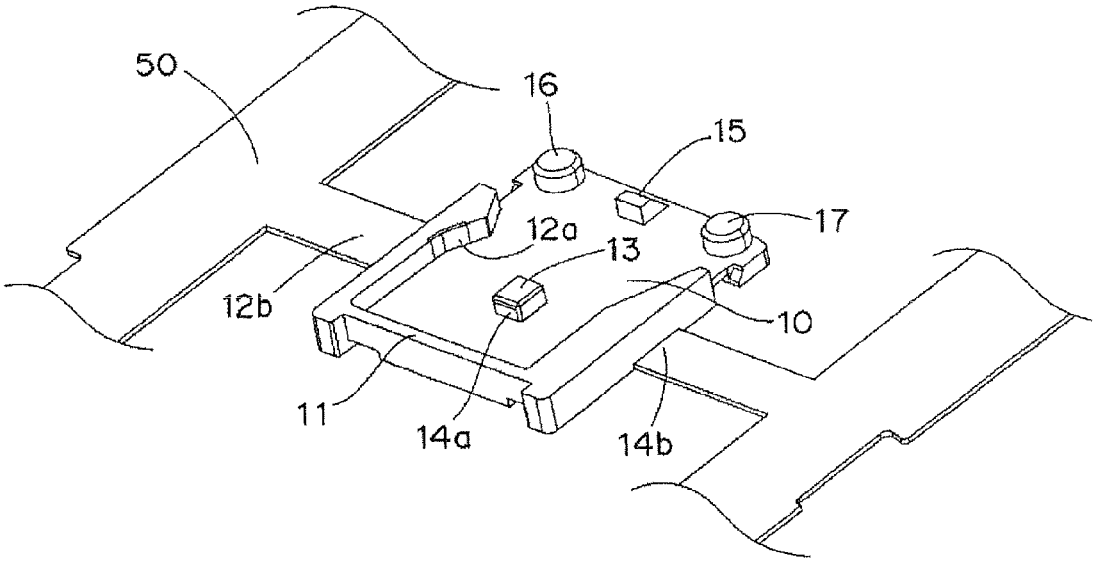
FIG. 5A and FIG. 5B are perspective views for illustrating the forming process of the switch illustrated in FIG. 4.
Figure 5B:
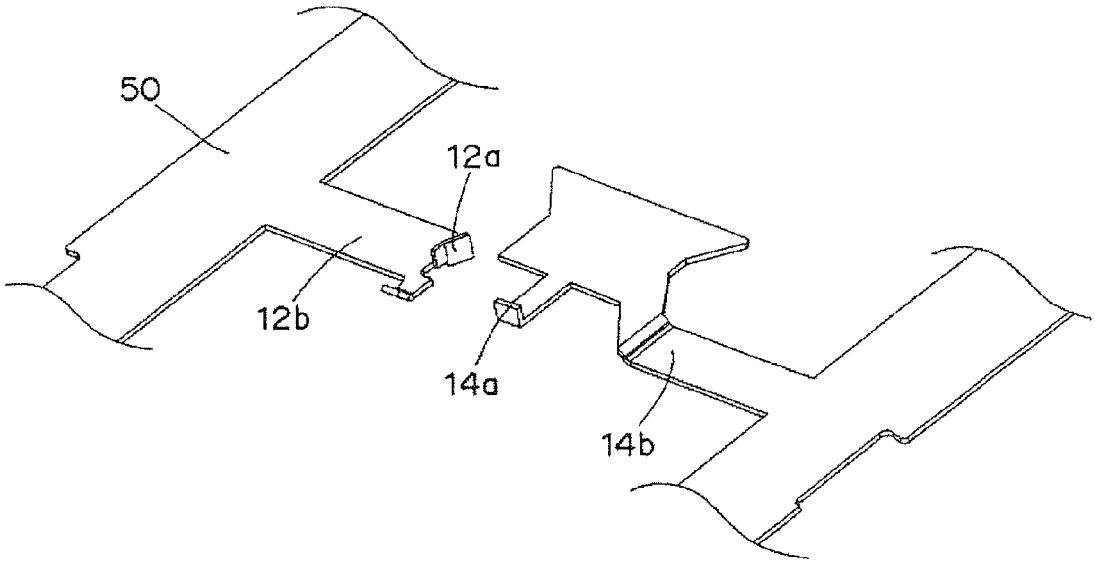

As illustrated in FIGS. 4A-4B, the second embodiment of the present invention is nearly similar to the first embodiment and is different therefrom in that the tip of the nearly U-shaped return spring 25 is formed as the movable contact 25*a* and that the normally open fixed contact 12*a* is formed at a position with which and from which the movable contact 25*a* can come into on- or off-contact with the inner side face of the frame 11 of the base 10. As illustrated in FIGS. 5A and 5B, the base 10 according to the second embodiment may be formed by insert molding with a lead frame 50. Because the other is the same as the first embodiment, the same components will be referred to as the same reference numerals, and the description thereof will be omitted.

The second embodiment forms the movable contact 25*a* at the tip of the nearly U-shaped return spring 25, thereby pressing the movable contact 25*a* against the normally open fixed contact 12*a* through the spring force of the return spring 25. This brings about an advantage that a switch having high contact reliability is achieved whose contact pressure is less likely to change even when vibration is applied.

Figure 6A:
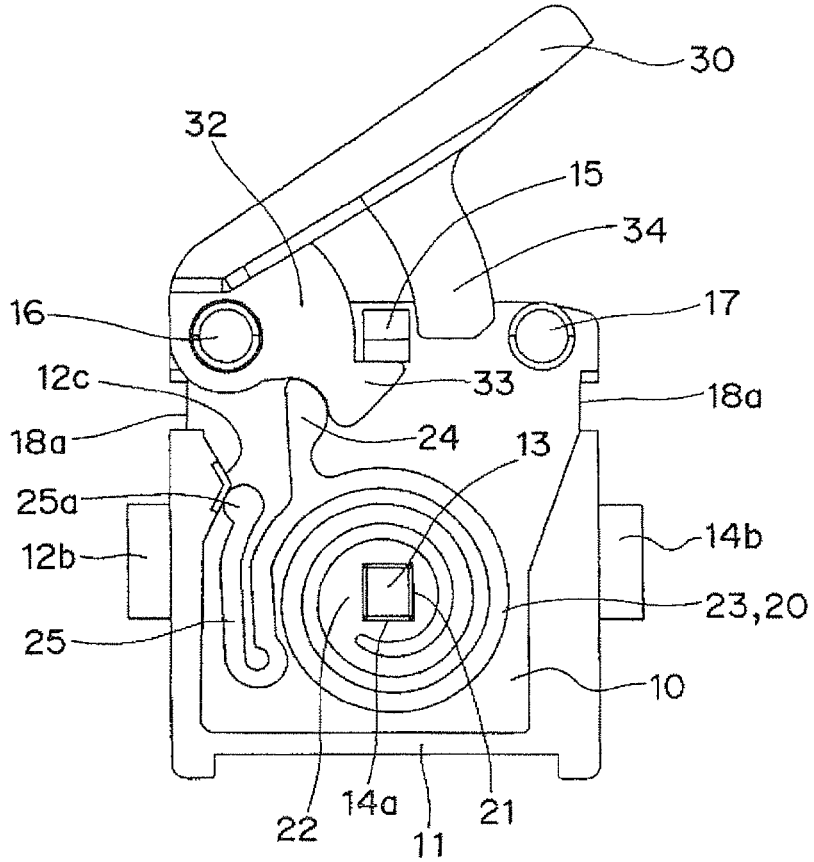
FIG. 6A and FIG. 6B are elevational views of a switch according to a third embodiment of the present invention before and after being operated, respectively.
Figure 6B:
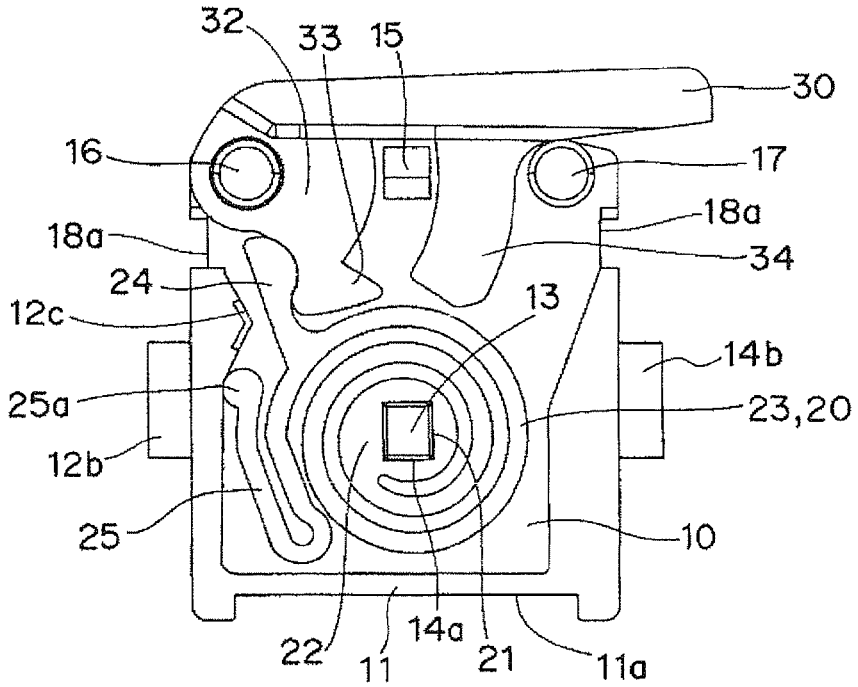

As illustrated in FIGS. 6A-6B, the third embodiment of the present invention is nearly similar to the first embodiment and is different therefrom in that the tip of the nearly U-shaped return spring 25 is formed as the movable contact 25*a* and that a normally closed fixed contact 12C is formed at a position with which and from which the movable contact 25*a* can come into on- or off-contact with the inner side face of the frame 11 of the base 10.

The third embodiment forms the movable contact 25*a* at the tip of the nearly U-shaped return spring 25, thereby pressing the movable contact 25*a* against the normally closed fixed contact 12*c* through the spring force of the return spring 25. This brings about an advantage that a switch having high contact reliability is achieved whose contact pressure is less likely to change even when vibration is applied.

It is understood that the switch according to one or more embodiments of the present invention can be used for, not only electronic devices such as mobile phones, other small-sized electronic devices such as digital cameras and video cameras.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

10 Base
11 Frame
12*a* Normally open fixed contact
12*c* Normally closed fixed contact
13 Support protrusion
14*a* Common fixed contact
15 Position restricting protrusion
16 Shaft
17 Stopper
20 Electrically conductive spring member
21 Fitting hole
22 Connecting part
23 Spiral spring
24 Driving piece
24*a* Movable contact
25 Return spring
25*a* Movable contact
30 Actuating lever
31 Shaft hole
32 Actuating trigger
33 Latch member
40 Cover

The invention claimed is:

1. A switch, comprising:

a base comprising:

a frame integrally formed on a periphery of an upper face of the base, a fixed contact formed on an inner side face of the frame, and a support protrusion that protrudes from the upper face of the base that is integrally formed so as to expose a common fixed contact;

an electrically conductive spring member whose connecting part arranged at a center of a spiral spring is nonrotatably supported by the support protrusion and that extends a driving piece from the free end of the spiral spring; and an actuating lever whose one end is rotatably supported by the upper face of the base and that integrally forms an actuating trigger that presses the driving piece of the electrically conductive spring member, wherein the fixed contact and the common fixed contact are electrically connected or disconnected through the electrically conductive spring member by rotating the actuating lever to press the driving piece of the electrically conductive spring member by the actuating trigger and elastically deforming the spiral spring thereby to cause the movable contact formed on the electrically conductive spring member to be connected or disconnected with the fixed contact.

2. The switch according to claim 1, wherein the movable contact is formed at the tip of the driving piece, and wherein the fixed contact and the common fixed contact are electrically connected or disconnected through the electrically conductive spring member by rotating the actuating lever to press the driving piece of the electrically conductive spring member by the actuating trigger and elastically deforming the spiral spring thereby to cause the movable contact to be connected or disconnected with the fixed contact.

3. The switch according to claim 1, wherein the driving piece and the movable contact are formed at the free end of the spiral spring in a branched manner, and wherein the fixed contact and the common fixed contact are electrically connected or disconnected through the electrically conductive spring member by rotating the actuating lever to press the driving piece of the electrically conductive spring member by the actuating trigger and elastically deforming the spiral spring thereby to cause the movable contact to be connected or disconnected with the fixed contact.

4. The switch according to claim 3, wherein the movable contact is arranged at the tip of a return spring that extends from the free end of the electrically conductive spring member.

5. The switch according to claim 1, wherein the electrically conductive spring member and the actuating trigger of the actuating lever have the same thickness dimension.

6. The switch according to claim 2, wherein the electrically conductive spring member and the actuating trigger of the actuating lever have the same thickness dimension.

7. The switch according to claim 3, wherein the electrically conductive spring member and the actuating trigger of the actuating lever have the same thickness dimension.

8. The switch according to claim 4, wherein the electrically conductive spring member and the actuating trigger of the actuating lever have the same thickness dimension.

* * * * *